US005211775A

United States Patent [19]

Fisher et al.

[11] Patent Number: 5,211,775

[45] Date of Patent: May 18, 1993

[54] REMOVAL OF OXIDE LAYERS FROM TITANIUM CASTINGS USING AN ALKALINE EARTH DEOXIDIZING AGENT

[75] Inventors: Richard L. Fisher; Stanley R. Seagle, both of Warren, Ohio

[73] Assignee: RMI Titanium Company, Niles, Ohio

[21] Appl. No.: 802,012

[22] Filed: Dec. 3, 1991

[51] Int. Cl.[5] ..... C21D 1/00

[52] U.S. Cl. ..... 148/421; 420/417

[58] Field of Search ..... 148/421; 420/417

[56] References Cited

U.S. PATENT DOCUMENTS

| | | | |
|---|---|---|---|
| 2,537,068 | 1/1951 | Lilliendahl et al. | 75/84 |
| 2,653,869 | 9/1953 | Gregory et al. | 75/84 |
| 2,834,667 | 5/1958 | Rostron | 75/0.5 |
| 4,373,947 | 2/1983 | Buttner et al. | 75/0.5 BB |
| 4,519,837 | 5/1985 | Down | 75/0.5 B |
| 4,923,531 | 5/1990 | Fisher | 148/133 |
| 5,022,935 | 6/1991 | Fisher | 148/133 |

*Primary Examiner*—Upendra Roy
*Attorney, Agent, or Firm*—Scully, Scott, Murphy, & Presser

[57] ABSTRACT

The invention relates to a process for the removal of oxides and/or oxygen which are formed on the surface of the casting during the investment casting process to levels that are comparable to those found within the bulk of the metal casting thus reducing the inherent hardness of the surfaces of the casting. More specifically, the invention relates to a process for removing oxide layers from titanium casting using an alkaline earth deoxidizing agent.

14 Claims, No Drawings

REMOVAL OF OXIDE LAYERS FROM TITANIUM CASTINGS USING AN ALKALINE EARTH DEOXIDIZING AGENT

FIELD OF INVENTION

The invention concerns a process for removing oxide and/or oxygen enriched layers which are formed on or near the surface of a metal casting during the investment casting process to levels which are substantially equivalent to the interior of the casting material. A preferred aspect of the invention relates to the use of a calcium metal as a deoxidizing agent.

BACKGROUND OF PRIOR ART

The invention concerns a process for the deoxidation of a metal casting which has oxide and/or oxygen enriched layers at or near the surface of the casting material. This process removes surface oxides and/or oxygen to levels that are nearly equal to that found in the bulk of the casting by using calcium as a deoxidant. Processes to reduce ores or metal oxides to metal frequently require extreme temperatures, as shown in the following: U.S. Pat. No. 2,834,667 to Rostron teaches direct thermal reduction of titanium dioxide by using metallic magnesium at temperatures exceeding 1000° C. U.S. Pat. No. 2,537,068 to Lilliendahl et al. shows the reduction of zirconium oxide or double chloride with calcium at temperatures between 1100° and 1200° C. U.S. Pat. No. 2,653,869 to Gregory et al. teaches the production of vanadium powder from vanadium trioxide mixed with calcium and calcium chloride at temperatures from 900° to 1350° C. U.S. Pat. No. 4,519,837 to Downs discusses a process for reducing metal oxide powders using molten lithium and magnesium or molten lithium and calcium metals at 600° C.

During the investment casting process, molds are made from refractory oxide or silicate slurries which are coated onto wax patterns. These molds are then fired at sufficiently high temperatures to remove the wax pattern and completely dry the mold. These molds are then cast by titanium or a titanium alloy under an inert atmosphere; however, a reaction between the molten titanium or alloy and the oxidic mold occurs, resulting in the formation of a thin layer of titanium oxide ($\alpha$-case) at or near the surface of the casting part. These oxygen enriched areas form very hard surface layers of low ductility which cause deterioration of strength and mechanical properties in the casting.

These oxygen enriched layers present at or near the surface of the titanium casting can be removed by grinding or pickling with acid solutions; however, these methods are difficult to control resulting in high metal losses. Other traditional methods for removing these oxide layers, like shot blasting, also suffer from similar limitations.

The use of calcium as a metal deoxidant is well known. Prior art methods require high temperatures and an excess of pure, expensive calcium. U.S. Pat. No. 4,923,531 to Fisher illustrates the use of a mixture of molten sodium and calcium at 950° C. to remove oxygen from thin titanium scraps and powders to very low levels. U.S. Pat. No. 5,022,935 to Fisher discusses the use of calcium metal to remove bulk oxygen from titanium scraps and powders.

SUMMARY OF THE INVENTION

A new process has been developed which permits the removal of oxides and/or oxygen which are formed on the surface of the casting to levels that are comparable to those found within the bulk of the metal casting thus reducing the inherent hardness of the surfaces of the casting. According to the present invention, a process is provided wherein a metal casting is contacted with a metallic deoxidant in a dry, inert atmosphere at temperatures and for times sufficient to at least liquify the metallic deoxidant and reduce the concentration of oxide and/or oxygen on the surface of the casting to levels which are found in the bulk of the casting. The resulting casting is then treated to remove oxides from the surface of the casting, e.g. by acid washing.

DETAILED DESCRIPTION

Titanium and titanium alloy casting are produced by investment casting. This process results in the formation of very thin, hard layers which contain high levels of oxygen at the surface of the casting. This invention provides a method of removing oxide and/or oxygen from the surface of the casting without loss of metal or changes in dimensions of the casting.

The present invention also results in a reduction in the surface hardness of the metal casting to levels which are found within the interior of the casting. It has been determined from the present examples that a reduction from about 10 to about 50% in surface hardness results when employing the process to a metal casting. This reduction of surface hardness is essential because it results in a metal casting having high ductility and improved strength and mechanical properties over a casting which is not treated with this process.

The removal of surface oxide or oxygen from metal castings is accomplished by placing or suspending the material in a suitable jig, preferably made from titanium or some other metal which is non-reactive with the casting, in a sealed retort which contains calcium. The calcium can be in a pure or alloyed form. The metal casting is preferably titanium or a titanium alloy. The atmosphere is removed by evacuation and filled with a suitable inert gas, e.g. argon or helium. Nitrogen is not used with certain metals like titanium because it can embrittle the metal casting.

The retort is then transferred to a furnace which is capable of maintaining temperatures from about 800° to 1000° C. for a time period of 6 to 24 hours. This treatment results in the vaporization of the calcium metal and promotes the reduction of titanium oxides found on the surface into a base metal and calcium oxide. It is a preferred aspect of this invention that the heat treatment be conducted under a pressure of about 1 psig; however, it is not limited to this value. Varying pressure from full vacuum up to several atmosphere have also been employed by this process. Furnaces suitable for this process include electric resistance, indirect gas fired, or induction heated furnaces.

After heat treatment, the retort is cooled under an inert gas atmosphere, opened and the casting is removed. The casting is then placed into any suitable leaching tank which contains a dilute acid. Any suitable mineral or organic acid may be used in this process, provided no insoluble precipitates are formed by reaction with the metallic deoxidant. In a preferred embodiment of the process, about 0.5 to about 5% hydrochloric acid is used to remove the oxide and/or oxygen from the casting. Other preferred acids which can be used include acetic and nitric acids. This procedure is carried out for a period of about two hours.

The casting is then washed with sufficient amounts of water until acid free and dried. The drying process can be accomplished in either air, inert gas or by forced gas convection, or accelerated by use of reduced pressure.

The deoxidant employed in the present process is a metal which readily forms oxides at the temperature employed but does not form an alloy with the metal casting. It is a preferred embodiment of this invention that the deoxidant is pure calcium metal. Calcium may be also added to the retort in the form of solid granules, shot, strips, bars, ingots, or liquids. The deoxidant may also be in the form of an alloy containing calcium and a metal which does not vaporize or interact with the titanium casting. Sodium is the preferred metal used in this process. Of course, other alkaline earth metals may be used as deoxiding agents, e.g. Ba or Sr.

PROCESS EQUIPMENT AND PROCEDURE

It is a preferred embodiment of the invention that the titanium casting be placed on a steel support plate to which lifting guides are welded. Thin titanium blocks in which holes have been drilled at regular intervals are placed in such a manner as to isolate and support the casting away from the steel support. Pure titanium, or alloy containing titanium are preferred for this purpose. Jigs made from similar materials can be used to hold the metal castings in place and prevent thermal distortion. If the casting are small, they may be suspended from the lid of the retort with suitable hangers. Calcium metal in the form of shot, turnings, chunk, ingot or liquid is placed in steel containers located beneath the supported casting.

The assembly containing the casting is then placed into an alloy steel retort by using a crane or other suitable lifting devices. The retort can be made from any alloy which is suitable for high temperature use. The retort may include, but not limited to, various grades of mild steel, stainless steel, inconel, and hastalloy. An insulated lid is attached to the retort by seal welding or by bolting a water cooled flange and O-ring to the retort. Flanged nozzles are welded to the lid assembly to accommodate valves used to evacuate the interior of the retort and through which an inert gas may be added. One of these flange assemblies may also include provisions for inserting a thermocouple well into the interior of the retort to monitor internal temperatures. After the lid has been attached securely to the retort with seal welds or O-rings and bolts, the retort is evacuated using mechanical vacuum pumps. When the pressure in the vessel reaches about 100–200 microns, the retort is isolated and allowed to stand for about 15 minutes. Leak rate is evaluated at this point. If the retort maintains vacuum for a reasonable period of time with minimal change in pressure level, it is refilled with argon or helium. The retort is then placed into a furnace and heated to a temperature of between 150° and 300° C. The retort is evacuated again to remove all traces of moisture and air and refilled with a pure inert gas.

When the deoxidation is performed in the preferred manner, the retort is refilled with high purity argon to atmospheric pressure. The retort is then heated to a preselected operating temperature between 800° and 1000° C. The retort can also be heated under vacuum. Normally, excess gas pressure is vented from the retort in order to maintain a constant pressure of 1 to 10 psig in the retort during heat treatment. When a constant temperature has been reached, it is maintained for a period of time required to convert the oxygen enriched surface layers present on the casting into titanium and calcium oxide. At the end of this heating period, usually between 6 and 24 hours, the retort is cooled to room temperature by shutting off power to the furnace or by removing the retort from the furnace and cooling it in an external rack. The retort can be air or water cooled until it reaches ambient temperature. The retort is maintained under at least 0.5 psig of argon pressure during this cooling period.

At the end of the cooling period, the retort lid is removed from the assembly by grinding, flame cutting or removing bolts from the flange assembly. The casting support jig is attached to a suitable lifting device using cables or chains and is removed from the retort. The retort and lid assembly are cleaned and dried using techniques known to those skilled in furnacing operations of this nature. The casting and support plate assembly are lowered into a suitable dip tank which contains a dilute solution of hydrochloric or other suitable acid. This acid solution can vary in concentration from 0.5% to 5.0% acid by volume. The acid solution is circulated around the casting assembly for a period of at least one hour. This circulation can be accomplished by mixing the solution with an agitator, pumping the acid solution out of a back into the tank through nozzles or by bubbling air, steam or other gas through the acid solution. At the end of the leach period, the tank is drained and the casting is rinsed with clean water until acid free. The casting and jig assembly are then removed from the leach tank. The casting is air dried or placed into a drying oven. This drying oven may be of a vacuum or convection design. Surface hardness of the casting can be tested with a portable hardness tester to insure that the hard, alpha case layer has been removed.

The following examples are given to further illustrate the invention.

EXAMPLE 1

A titanium alloy casting cast from six aluminum, four vanadium alloy was placed in a jig in a steel retort. Solid calcium shot was placed in a boat below the casting. The retort was evacuated and refilled with argon gas. The retort was heated to 920° C. and held for a period of 19 hours under an argon pressure of 1 psig. The furnace was cooled under argon pressure and the retort opened. After the casting was removed, it was leached in a large beaker in which dilute hydrochloric acid was circulated around the casting with a mechanical stirrer. The casting was rinsed with water until acid free and dried in a vacuum drying oven at a temperature of approximately 105° C. Samples were cut from the casting before and after treatment. The sample of the untreated casting showed an average surface hardness of 691 DPH (diamond pyramid hardness scale) in a layer ten to fifteen thousands of an inch thick on the surfaces of the casting. After treatment the hardness of this layer was reduced to an average level of 353 DPH. Average surface hardness, which is a measure of oxygen content in titanium, was reduced to slightly less than that measured within the interior of the casting, 361, 395, and 355 DPH respectively.

EXAMPLE 2

Half of an H-Shaped titanium alloy investment casting which was cast from a titanium six aluminum, four vanadium alloy was secured in a titanium jig and loaded into a retort. Calcium metal was placed in a container beneath the jig-casting assembly. The retort was evacuated and refilled with argon gas. The retort was placed in an electrically heated furnace and heated to 960° C. It was held for a period of several hours under a pressure of 1 psig of argon gas. After cooling, the jig assembly was removed and the casting was washed by circulating a dilute hydrochloric acid solution around the casting for approximately one hour. The acid was removed and the casting was washed with water and dried in a vacuum drying oven. The bulk oxygen in a sample cut from the casting was reduced from an initial level of 0.258% to a value of 0.174% after the oxide layer removal treatment. The average microhardness of layers approximately 15 thousands of an inch thick on the surface of the casting was reduced from an initial value of 500 DPH to a level of 327 DPH after treatment. The average hardness across the casting was found to be 349 DPH. The alpha phase layer present on the casting surfaces was not visible in photomicrographs taken of treated samples etched with dilute hydrofluoric acid.

EXAMPLE 3

Another half casting cut from an H-Shaped titanium alloy casting which had been cast from titanium six aluminum, four vanadium alloy was secured in a titanium jig and loaded into the retort. Calcium metal was placed in a container beneath the jig-casting assembly. The retort was evacuated and refilled with argon gas. The retort was placed in an electrically heated furnace and heated to 900° C. where it was held for a period of eight hours under a pressure of 1 psig of argon gas. After cooling, the jig assembly was removed and the casting was washed by circulating a dilute, 1.0% hydrochloric acid solution around the casting for about one hour. The acid was removed and the casting was then washed with water and dried in a vacuum drying oven. The bulk oxygen of a sample cut from the casting was reduced from an initial level of 0.2150% to a value of 0.1790% after the oxide removal treatment. The average microhardness of a layer approximately 15 thousands of an inch thick on the surfaces of the casting was reduced from an initial value of 406 DPH to a level of 373 DPH after treatment. The average hardness across the casting was found to be 367 DPH. The alpha phase layer present on the casting surfaces was not visible in photomicrographs taken of treated samples after etching with dilute hydrofluoric acid. The original cross sectional dimensions of this casting was measured with a micrometer and were found to be 0.409 inches on each side. After deoxidation and acid leaching, these dimensions were found to still be 0.409 inches on a side.

EXAMPLE 4

Another half casting cut from an H-Shaped titanium alloy casting which had been cast from titanium six aluminum, four vanadium alloy was secured in a titanium jig and loaded into the retort. Calcium metal shot was placed in a container beneath the jig-casting assembly. The retort was evacuated and refilled with argon gas. The retort was placed in an electrically heated furnace and heated to 900° C. where it was held for period of twelve hours under a pressure of 1 psig of argon gas. After cooling, the jig assembly was removed and the casting was washed by circulating a dilute, 1.05 hydrochloric acid solution around the casting for about one hour. The acid was removed and the casting was then washed with water and dried in a vacuum drying oven. The bulk oxygen of a sample cut from the casting was reduced from an initial level of 0.2360% to a value of 0.1850% after the oxide removal treatment. The average microhardness of a layer approximately 15 thousands of an inch thick on the surfaces of the casting was reduced from an initial value of 433 DPH to a level of 380 DPH after treatment. The average hardness across the casting was found to be 360 DPH. The alpha phase layer present on the casting surfaces was not visible in photomicrographs taken of treated samples after etching with dilute hydrofluoric acid. Original dimensions measured with a micrometer were found to be the same after deoxidation and acid cleaning for this casting sample.

What is claimed is:

1. A process for removing oxygen from oxide and/or oxygen enriched layers which are formed on the surface of a metal casting of titanium or titanium alloy during the casting process to levels equal to or below concentrations found in the interior of the casting comprising:

(a) contacting a metal casting of titanium or titanium alloy having oxide and/or oxygen enriched layers formed on the surface thereof with a metal deoxidant in a dry, inert atmosphere at an elevated temperature sufficient to at least vaporize the metal deoxidant and maintaining contact of the vaporized metal deoxidant with the surface of said casting to form metal deoxidant oxide until the oxide and/or oxygen in the surface is reduced to substantially equate the concentration thereof in the interior of the casting; and (b) acid washing the casting to remove metal deoxidant oxide on the surface of the casting.

2. A process according to claim 1 wherein said metal deoxidant comprises calcium.

3. A process according to claim 1 wherein said interior oxygen concentration is from about 0.05 to about 1.0 percent.

4. A process according to claim 1 wherein said interior oxygen concentration is from about 0.1 to about 0.8 percent.

5. A process according to claim 1 wherein said oxide or oxygen-enriched layers are from about 10 to about 20 thousandths of an inch thickness.

6. A process according to claim 1 wherein said contacting step is conducted at a temperature of at least about 800° C.

7. A process according to claim 2 wherein the deoxidant is comprised of a mixture of calcium and sodium.

8. A process according to claim 5 wherein said contacting step is conducted at from about 800° to about 1000° C.

9. A process according to claim 6 wherein said contacting is maintained for about 6 to about 24 hours.

10. A process according to claim 8 wherein said heat treatment is conducted at a pressure of from about 1 to about 10 psig.

11. A process according to claim 10 wherein said heat treatment is conducted at a pressure from about 10 microns of vacuum to a pressure of 1 psig.

12. A metal casting of titanium or titanium alloy wherein the oxide and/or oxygen levels in the casting surface is substantially equal to the levels of oxide and/or oxygen in the interior of said casting.

13. A metal casting according to claim 12 wherein said interior oxygen concentration is from about 0.05 to about 1.0 percent.

14. A metal casting according to claim 12 wherein said interior oxygen concentration is from about 0.1 to about 0.8 percent.

* * * * *